US008864918B2

(12) United States Patent
Clemens et al.

(10) Patent No.: US 8,864,918 B2
(45) Date of Patent: Oct. 21, 2014

(54) METHOD FOR PRODUCING A COMPONENT AND COMPONENTS OF A TITANIUM-ALUMINUM BASE ALLOY

(75) Inventors: Helmut Clemens, Leoben (AT); Wilfried Wallgram, Leoben (AT); Martin Schloffer, Leoben (AT)

(73) Assignees: Boehler Schmiedetechnik GmbH & Co. KG, Kapfenberg (AT); MTU Aero Engines GmbH, Munich (DE)

( * ) Notice: Subject to any disclaimer, the term of this patent is extended or adjusted under 35 U.S.C. 154(b) by 841 days.

(21) Appl. No.: 13/099,970

(22) Filed: May 3, 2011

(65) Prior Publication Data

US 2011/0277891 A1 Nov. 17, 2011

(30) Foreign Application Priority Data

May 12, 2010 (AT) ..... A 802/2010

(51) Int. Cl.

| | |
|---|---|
| ***C22C 14/00*** | (2006.01) |
| ***C22F 1/18*** | (2006.01) |
| ***C22C 33/02*** | (2006.01) |
| ***B22F 1/00*** | (2006.01) |
| ***B22F 3/15*** | (2006.01) |
| ***B22F 3/04*** | (2006.01) |
| ***C22C 1/04*** | (2006.01) |
| ***C22C 1/02*** | (2006.01) |

(52) U.S. Cl.

CPC ..... *C22C 14/00* (2013.01); *C22F 1/183* (2013.01); *C22C 1/0458* (2013.01); *B22F 2998/10* (2013.01); *C22C 1/02* (2013.01)

USPC ..... 148/421; 148/670; 419/25; 419/39; 419/42; 419/49; 419/66

(58) Field of Classification Search

CPC ..... C22C 1/02; C22C 1/0458; C22C 14/00; C22F 1/183; B22F 2998/10; B22F 3/15–3/17; B22F 2003/248

USPC ..... 148/421, 670; 419/25, 39, 42, 49, 68

See application file for complete search history.

(56) References Cited

U.S. PATENT DOCUMENTS

| | | | |
|---|---|---|---|
| 5,190,603 | A | 3/1993 | Nazmy et al. |
| 5,226,985 | A | 7/1993 | Kim et al. |
| 5,442,847 | A | 8/1995 | Semiatin et al. |
| 6,669,791 | B2 | 12/2003 | Tetsui et al. |
| 6,805,759 | B2 | 10/2004 | Hoffmann et al. |
| 2010/0015005 | A1 | 1/2010 | Oehring et al. |
| 2010/0329877 | A1 | 12/2010 | Kremmer et al. |

FOREIGN PATENT DOCUMENTS

| | | | |
|---|---|---|---|
| DE | 102004056582 | | 6/2006 |
| DE | 102007051499 | A1 | 4/2009 |
| EP | 0464366 | A1 | 1/1992 |
| EP | 1127949 | A2 | 8/2001 |
| EP | 2272993 | | 1/2011 |
| JP | 2002-356729 | | 12/2002 |
| WO | 03/008655 | A2 | 1/2003 |

OTHER PUBLICATIONS

Helmut Clemens et al., "Intermetallic Titanium Aluminide a An Innovative Low-weight Material for High-temperature Applications; Intermetallisches Titanaluminid a Ein innovativer Leichtbauwerkstoff fA 1/4 r Hochtemperaturanwendungen", BHM Berg—Und Ha 1/4 Ttenma Nnische Monatshefte ; Zeitschrift FA 1/4 R Rohstoffe, Geotechnik, Metallurgie, Werkstoffe, Maschinenund Anlagentechnik, Springer-Verlag, Vienna, Bd. 156, Nr. 7, XP019941410, Jul. 1, 2011, pp. 255-260.

Imaev R M et al., "Refining of the microstructure of cast intermetallic alloy Ti—43% Al X (Nb, Mo, B) with the help of heat treatment", Metal Science and Heat Treatment, Springer, New York, NY, US, Bd. 48, Nr. 1-2, XP002510776, Jan. 1, 2006, pp. 81-84.

Schmoelzer T et al., "Phase fractions, transition and ordering temperatures in TiAl-Nb-Mo alloys: An in-and ex-situ study", Intermetallics, Elsevier Science Publishers B. V, GB, Bd. 18, Nr. 8, XP027099742 , Aug. 1, 2010, pp. 1544-1552.

Clemens H et al., "In and ex situ investigations of the beta-phase in a Nb and Mo containing gamma-TiAl based alloy ", Intermetallics, Elsevier Science Publishers B. V, GB, Bd. 16, Nr. 6, XP022691290, Jun. 1, 2008, pp. 827-833.

Habel U et al., "Processing, Microstructure and Tensile Properties of. Gamma.-Tial Pm Alloy 395MM ", Gamma, Titanium, Aluminides, Proceedings of a Symposium; 20030000, 2003, XP008068139, pp. 297-304.

Guether Volker et al., "Microstructure and corresponding tensile properties of as-cast, . beta .-solidifying, . gamma -TiAl based TNM alloys", Gamma, Titanium, Aluminides, Proceedings of a Symposium, XX, XX, XP008068139, pp. 297-304.

D. Zhang et al., "Effect of heat-treatments and hot-isostatic pressing on phase transformation and microstructure in a B/B2 containing Gamma-TiAl based alloy", Scripta Materialia, Bd. 42, Nr. 11, XP002660479, May 31, 2000, pp. 1065-1070.

(Continued)

*Primary Examiner* — Roy King
*Assistant Examiner* — Caitlin Kiechle
(74) *Attorney, Agent, or Firm* — Greenblum & Bernstein, P.L.C.

(57) ABSTRACT

A method for producing a component of a titanium-aluminum base alloy comprising hot isostatically pressing the alloy to form a blank, subjecting the blank to a hot forming by a rapid solid-blank deformation, followed by a cooling of the component to form a deformation microstructure with high recrystallization energy potential, thereafter subjecting the component to a heat treatment in the range of the eutectoid temperature ($T_{eu}$) of the alloy, followed by cooling in air, to form a homogeneous, fine globular microstructure composed of phases GAMMA, $BETA_0$, $ALPHA_2$ and having an ordered atomic structure at room temperature. This abstract is neither intended to define the invention disclosed in this specification nor intended to limit the scope of the invention in any way.

16 Claims, 3 Drawing Sheets

(56) References Cited

OTHER PUBLICATIONS

Eberhardt N Lorich A Joerg R Kestler H Knabl W Koeck W Baur H Joos R Clemens H, "Pulvermetallurgische Herstellung and Charakterisierung von Formkoerpern einer intermetallischen Ti-46. 5A1-4 (Cr, Nb, Ta, B)—Legierung =powder metallurgical manufacturing and characterisation of components made of intermetallic alloy Ti-46. 5A1-4 (Cr, Nb, Ta, B)", Zeitschrift Fur Metallkunde, Carl Hanser, Munich, DE, Bd. 89, Nr. 11, XP009152695, Jan. 1, 1998, pp. 772-778.

H. Clemens et al., "Design of Novel I3-Solidifying TiAl Alloys with adjustable (β/B2-Phase Fraction and Excellent Hot-Workability", Advanced Engineering Materials, Bd. 10, Nr. 8, 2008, pp. 707-713, XP002660480.

Search report from E.P.O.that issued with respect to patent family member European Patent Application No. 11450055 6, mail date is Oct. 17, 2011.

METHOD FOR PRODUCING A COMPONENT AND COMPONENTS OF A TITANIUM-ALUMINUM BASE ALLOY

CROSS-REFERENCE TO RELATED APPLICATIONS

The present application claims priority under 35 U.S.C. §119 of Austrian Patent Application No. A 802/2010, filed on May 12, 2010, the entire disclosure of which is expressly incorporated by reference herein.

BACKGROUND OF THE INVENTION

1. Field of the Invention

The invention relates to a method for producing a component of a titanium-aluminum base alloy. Furthermore, the invention relates to a component of a titanium-aluminum base alloy, produced with near net shape dimensions.

2. Discussion of Background Information

Titanium-aluminum base alloys in general have a high strength, a low density and good corrosion resistance and are preferably used as components in gas turbines and aircraft engines.

For the above fields of application, in particular alloys with a composition of: aluminum 40 atomic % to 50 atomic %, niobium 3 atomic % to 10 atomic %, molybdenum up to 4 atomic % as well as optionally the elements manganese, boron, silicon, carbon, oxygen and nitrogen in low concentrations as well as titanium as a remainder are of interest.

These alloys preferably solidify completely via the β mixed crystal and pass through a number of phase transformations during a subsequent cooling. A schematic diagram (FIG. 1) shows microstructure formations as a function of the temperature and the aluminum concentration with temperature range data used by one skilled in the art.

The components can be produced by casting a block or by means of powder metallurgy through hot isostatic pressing (HIPing) of alloyed metal powder as well as by casting a block and optionally HIPing of the same with subsequent extrusion molding and respectively with a subsequent forging of the block or intermediate product to form a component, which is subsequently subjected to heat treatments.

Titanium-aluminum materials have only a narrow temperature window for a hot forming, although it can be expanded by the alloying elements niobium and molybdenum, but nevertheless limitations result regarding the deformation or forging of the parts. It is known to produce a component at least in part by non-cutting shaping, by means of slow isothermal deformation, known to one skilled in the art as isothermal forging, but this is associated with high expenditure.

At best, a component produced according to the above technologies will not usually have a homogeneous fine structure because, on the one hand, there is a low and unequal recrystallization potential of the slowly isothermally deformed material, and/or, on the other hand, the diffusion of the atoms of the elements niobium and/or molybdenum requiring a large time expenditure, which are important for a deformability of a material, are aligned according to the forming structure and can thus have a disadvantageous effect on the structure.

Although a homogenization of the microstructure formation and thus the achievement of isotropic mechanical properties of the material through time-consuming annealing treatments is possible on principle, it requires a high expenditure.

For industrial practice, components of a titanium-aluminum base alloy are necessary which have homogeneous mechanical properties independent of direction, wherein the ductility, strength and creep resistance of the material are present in a balanced manner at a high level even at high application temperatures.

It would be advantageous to have available a method with which a component can be produced with homogeneous, fine and uniform microstructure, which component has a balanced ductility, strength and creep resistance of the material in all directions essentially equally at a desired high level and can be produced economically with near net shape dimensions.

It would further be desirable to have available a component which with a targeted phase formation of the microstructure has desired mechanical properties, in particular a yield strength $R_{p0.2}$ and a strength $R_m$ as well as total elongation $A_t$ in the tensile strength test at room temperature and at a temperature of 700° C.

SUMMARY OF THE INVENTION

The present invention provides a method for producing a component of a titanium-aluminum base alloy. The method comprises (a) after a through heating for at least about 60 minutes, isostatically pressing, with an increase in pressure to at least about 150 MPa at a temperature of at least about 1000° C., an alloy produced by melting metallurgy or powder metallurgy and having a chemical composition of, in atomic %:

Aluminum (Al) from about 41 to about 48
and, optionally, one or more of:
Niobium (Nb) from about 4 to about 9
Molybdenum (Mo) from about 0.1 to about 3.0
Manganese (Mn) up to about 2.4
Boron (B) up to about 1.0
Silicon (Si) up to about 1.0
Carbon (C) up to about 1.0
Oxygen (O) up to about 0.5
Nitrogen (N) up to about 0.5
remainder titanium and impurities,
to form a blank, (b) subjecting the blank of (a) to a hot forming by a rapid solid-blank deformation at a rate of greater than about 0.4 mm/sec and a deformation by compression measured as local expansion ϕ of greater than about 0.3, ϕ being defined as:

$$\phi = \ln(h_f/h_o)$$

$h_f$=height of the workpiece after compression
$h_o$=height of the workpiece before compression or to a different forming method with the same minimum deformation, followed by a cooling of the component, wherein the time until a temperature of 700° C. is reached is no more than about 10 min., to form a microstructure that may be dynamically recovered or recrystallized only in small partial regions, but essentially has a deformation microstructure with high recrystallization energy potential, (c) for an adjustment of desired material properties, subjecting the component of (b) to a heat treatment in the range of the eutectoid temperature ($T_{eu}$) of the alloy for from about 30 min to about 1000 min, followed by cooling in air, to form from a deformation microstructure, due to the stored deformation energy and the driving force for the microstructure rearrangement, which consists of the chemical phase imbalance after the deformation and cooling, a homogeneous, fine globular microstructure composed of the phases GAMMA, $BETA_0$, $ALPHA_2$ ($\gamma$, $\beta_0$, $\alpha_2$) and having an ordered atomic structure at room temperature:

$ALPHA_2$: globular with a grain size of from about 1 μm to about 50 μm with a volume proportion of from about 1% to about 50% which may contain isolated, coarser γ lamellae with a thickness of >about 100 nm;

$BETA_0$: globular surrounding the $\alpha_2$ phase, with a grain size of from about 1 μm to about 25 μm with a volume proportion of from about 1% to about 50%;

GAMMA: globular surrounding the $\alpha_2$ phase, with a grain size of from about 1 μm to about 25 μm with a volume proportion of from about 1% to about 50%;

(d) optionally, subjecting the component of (c) to at least one further heat treatment.

In on aspect of the method, in (b) the blank may be subjected to forging at a temperature of from about 1000° C. to about 1350° C. as the different forming method with the same minimum deformation as the hot forming by a rapid solid-blank deformation.

In another aspect of the method, the range of the eutectoid temperature ($T_{eu}$) of the alloy may be from about 1010° C. to about 1180° C.

In yet another aspect, in (d) a post-annealing and/or a stabilizing annealing may be carried out.

In a still further aspect of the method of the present invention, the alloy may have a chemical composition of, in atomic %:

Al from about 42 to about 44.5
and, optionally, one or more of:
Nb from about 3.5 to about 4.5
Mo from about 0.5 to about 1.5
Mn up to about 2.2
B from about 0.05 to about 0.2
Si from about 0.001 to about 0.01
C from about 0.001 to about 1.0
O from about 0.001 to about 0.1
N from about 0.0001 to about 0.02,
remainder titanium and impurities.

In another aspect of the method of the present invention, for an adjustment of desired material properties the component may be subjected in (c) to a heat treatment that takes place in the range of the eutectoid temperature ($T_{eu}$) of the alloy, e.g., from about 1040° C. to about 1170° C., followed by cooling in air for from about 30 min to about 600 min, to form from the deformation microstructure a homogeneous, fine globular microstructure composed of phases GAMMA, $BETA_0$, $ALPHA_2$ ($\gamma$, $\beta_0$, $\alpha_2$) having an ordered atomic structure at room temperature:

$ALPHA_2$: globular with a grain size of from about 1 μm to about 10 μm with a volume proportion of from about 10% to about 35% which may contain isolated, coarser γ lamellae with a thickness of >about 100 nm;

$BETA_0$: globular surrounding the $\alpha_2$ phase, with a grain size of from about 1 μm to about 10 μm with a volume proportion of from about 15% to about 45%;

GAMMA: globular surrounding the $\alpha_2$ phase, with a grain size of from about 1 μm to about 10 μm with a volume proportion of from about 15% to about 60%.

In another aspect of the method, for adjusting optimized high-temperature material properties the component may be subjected in (d) to at least one post-annealing that is carried out close to the alpha-transus temperature ($T_\alpha$) of the alloy in the triple phase space (alpha, beta, gamma) for from at least about 30 min to no more than about 6000 min, followed by cooling the component for less than about 10 min to a temperature of about 700° C. and further cooling, preferably in air, to result in a phase formation:

$ALPHA_2$: globular supersaturated, optionally containing few fine γ lamellae, with a grain size of from about 5 μm to about 100 μm with a volume proportion of from about 25% to about 98%;

$BETA_0$: globular, with a grain size of from about 1 μm to about 25 μm with a volume proportion of from about 1% to about 25%;

GAMMA: globular, with a grain size of from about 1 μm to about 25 μm with a volume proportion of from about 1% to about 50%.

In another aspect of the method, for adjusting optimized high-temperature material properties the component may be subjected in (d) to at least one post-annealing that is carried out close to the alpha-transus temperature ($T_\alpha$) of the alloy in the triple phase space (alpha, beta, gamma) for from at least about 30 min to no more than about 6000 min, followed by cooling the component for less than about 10 min to a temperature of about 700° C. and further cooling, preferably in air, to result in a phase formation:

$ALPHA_2$: globular supersaturated, optionally containing few fine γ lamellae, with a grain size of from about 5 μm to about 80 μm with a volume proportion of from about 50% to about 98%;

$BETA_0$: globular, with a grain size of from about 1 μm to about 20 μm with a volume proportion of from about 1% to about 25%;

GAMMA: globular, with a grain size of from about 1 μm to about 20 μm with a volume proportion of from about 1% to about 28%.

In another aspect of the method, after the at least one post-annealing set forth above the component may be subjected to at least one stabilizing annealing at a temperature of from about 700° C. to about 1000° C., at best above the application temperature of the component, for from about 60 min to about 1000 min, followed by a slow cooling or furnace cooling at a rate of less than about 5° C./min, e.g., less than about 1° C./min to adjust or develop the microstructural constituents:

$ALPHA_2$/GAMMA: lamellar grain with a grain size of from about 5 μm to about 100 μm with a volume proportion of from about 25% to about 98% with a ($\alpha_2/\gamma$) lamellar fine structure preferably with an average lamellar spacing of from about 10 nm to about 1 μm;

$BETA_0$: globular, with a grain size of from about 1 μm to about 25 μm with a volume proportion of from about 1% to about 25%;

GAMMA: globular, with a grain size of from about 1 μm to about 25 μm with a volume proportion of from about 1% to about 50%.

In yet another aspect of the method, after the at least one post-annealing set forth above the component may be subjected to at least one stabilizing annealing at a temperature of from about 700° C. to about 1000° C., at best above the application temperature of the component, for from about 60 min to about 1000 min, followed by a slow cooling or furnace cooling at a rate of less than about 5° C./min, e.g., less than about 1° C./min, to adjust or develop the microstructural constituents:

$ALPHA_2$/GAMMA: lamellar grain with a grain size of from about 5 μm to about 80 μm with ($\alpha_2/\gamma$) lamellar fine structure preferably, with an average lamellar spacing of from about 10 nm to about 30 nm, and with a volume proportion of from about 45% to about 90%;

$BETA_0$: globular, with a grain size of from about 1 μm to about 20 μm with a volume proportion of from about 1% to about 25%;

GAMMA: globular, with a grain size of from about 1 μm to about 20 μm with a volume proportion of from about 1% to about 25%.

The present invention also provides a component of a titanium-aluminum base alloy with a chemical composition as set forth above, produced with near net shape dimensions, preferably with a method as set forth above, wherein the microstructure of the component is composed of phases GAMMA, $BETA_0$, $ALPHA_2$ (γ, ($\beta_0$, $\alpha_2$) having an ordered atomic structure at room temperature:

$ALPHA_2$: globular with a grain size of from about 1 μm to about 50 μm with a volume proportion of from about 1% to about 50% which may contain isolated, coarser γ lamellae with a thickness of >about 100 nm;

$BETA_0$: globular surrounding the $\alpha_2$ phase, with a grain size of from about 1 μm to about 25 μm with a volume proportion of from about 1% to about 50%;

GAMMA: globular surrounding the $\alpha_2$ phase, with a grain size of from about 1 μm to about 25 μm with a volume proportion of from about 1% to about 60%, and adjusted, preferably with a method as set forth above, to have the following mechanical properties:

Strength and elongation at break at room temperature:

$R_{p0.2}$: from about 650 to about 910 MPa $R_m$: from about 680 to about 1010 MPa $A_t$: from about 0.5% to about 3%

Strength and elongation at break at 700° C.:

$R_{p0.2}$: from about 520 to about 690 MPa $R_m$: from about 620 to about 970 MPa $A_t$: from about 1% to about 3.5%.

The present invention also provides a component of a titanium-aluminum base alloy with a chemical composition as set forth above, produced with near net shape dimensions, wherein the microstructure of the component is composed of the following phases:

$ALPHA_2$: globular supersaturated, optionally containing few fine γ lamellae, with a grain size of from about 5 μm to about 80 μm with a volume proportion of from about 50% to about 95%;

$BETA_0$: globular, with a grain size of from about 1 μm to about 20 μm with a volume proportion of from about 1% to about 25%;

GAMMA: globular, with a grain size of from about 1 μm to about 25 μm with a volume proportion of from about 1% to about 28%, and adjusted, preferably with a method as set forth above, to have the following mechanical properties:

Strength and elongation at break (according to ASTM E8M, EN 2002-1) at room temperature:

$R_{p0.2}$: from about 650 to about 940 MPa $R_m$: from about 730 to about 1050 MPa $A_t$: from about 0.2% to about 2%

Strength and elongation at break at 700° C.:

$R_{p0.2}$: from about 430 to about 620 MPa $R_m$: from about 590 to about 940 MPa $A_t$: from about 1% to about 2.5%.

The present invention also provides a component of a titanium-aluminum base alloy with a chemical composition as set forth above, produced with near net shape dimensions, wherein the component has a microstructure composed of the following phases:

$ALPHA_2$/GAMMA: Lamella grain with a grain size of from about 5 μm to about 100 μm with a volume proportion of from about 25% to about 98% with a ($\alpha_2$/γ) lamellar fine structure preferably with an average lamellar spacing of from about 10 nm to about 1 nm;

$BETA_0$: globular, with a grain size of from about 0.5 μm to about 25 μm with a volume proportion of from about 1% to about 25%;

GAMMA: globular, with a grain size of from about 0.5 μm to about 25 μm with a volume proportion of from about 1% to about 50%, and adjusted, preferably with a method as set forth above, to have the following mechanical properties:

Strength and elongation at break (according to ASTM E8M, EN 2002-1) at room temperature:

$R_{p0.2}$: from about 710 to about 1020 MPa $R_m$: from about 800 to about 1250 MPa $A_t$: from about 0.8% to about 4%

Strength and elongation at break at 700° C.:

$R_{p0.2}$: from about 540 to about 760 MPa $R_m$: from about 630 to about 1140 MPa $A_t$: from about 1% to about 4.5%.

BRIEF DESCRIPTION OF THE DRAWINGS

The present invention is further described in the detailed description which follows, in reference to the drawings by way of non-limiting examples of exemplary embodiments of the present invention, and wherein.

DETAILED DESCRIPTION OF THE PRESENT INVENTION

Figure 1:
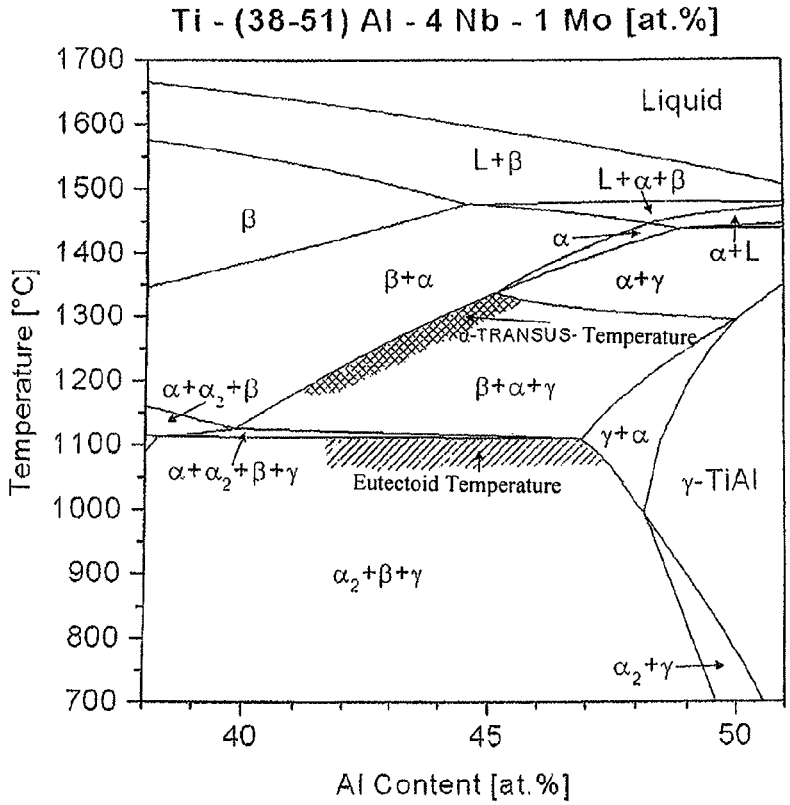
FIG. 1 is a diagram showing a microstructure formation as a function of the temperature and the aluminum concentration with temperature range data used by one skilled in the art.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

According to the present invention in a method of the type mentioned at the outset, in a first step a starting material (alloy) is produced by means of melting metallurgy or powder metallurgy with a chemical composition of, in atomic %:

Aluminum (Al) from about 41 to about 48, and, optionally, one or more of:

Niobium (Nb) from about 4 to about 9

Molybdenum (Mo) from about 0.1 to about 3.0

Manganese (Mn) up to about 2.4

Boron (B) up to about 1.0

Silicon (Si) up to about 1.0

Carbon (C) up to about 1.0

Oxygen (O) up to about 0.5
Nitrogen (N) up to about 0.5,
remainder titanium and impurities,
and this starting material, with an increase in pressure to at least about 150 MPa at a temperature of at least about 1000° C., after a through heating for a duration of at least about 60 minutes, is pressed isostatically to form a blank, after which in a second step the HIP blank is subjected to a hot forming by a rapid solid-blank deformation at a speed of greater than about 0.4 mm/sec and a deformation by compression measured as local elongation $\phi$ of greater than about 0.3, wherein $\phi$ is defined as follows:

$$\phi=\ln(h_f/h_o)$$

$h_f$=height of the workpiece after compression
$h_o$=height of the workpiece before compression or a different deformation method with the same minimum deformation, in particular by forging at a temperature in the range of from about 1000° C. to about 1350° C. with shaping of a component with a subsequent cooling of the same, wherein the time until a temperature of about 700° C. is reached is no more than about 10 min., wherein a microstructure, which may be dynamically recovered or recrystallized only in small partial regions, however, essentially has a deformation microstructure with high recrystallization energy potential, is formed, after which for an adjustment of desired material properties the component is subjected to a heat treatment in a third step in which, in the range of the eutectoid temperature of the alloy, in particular from about 1010° C. to about 1180° C., within a period of time of from about 30 min to about 1000 min, from the deformation microstructure, due to the stored deformation energy and the driving force which consists of the chemical phase imbalance after the deformation and cooling, a homogeneous, fine globular microstructure, composed of the phases having an ordered atomic structure at room temperature:

GAMMA, $BETA_0$, $ALPHA_2$ ($\gamma$, $\beta_0$, $\alpha_2$)

with a formation:

$ALPHA_2$: globular with a grain size of from about 1 μm to about 50 μm with a volume proportion of from about 1% to about 50% which may contain isolated, coarser $\gamma$ lamellae with a thickness of >about 100 nm;

$BETA_0$: globular surrounding the $\alpha_2$ phase, with a grain size of from about 1 μm to about 25 μm with a volume proportion of from about 1% to about 50%;

GAMMA: globular surrounding the $\alpha_2$ phase, with a grain size of from about 1 μm to about 25 μm with a volume proportion of from about 1% to about 60%;

is formed, and in a following step at least one further heat treatment, in particular post-annealing and/or stabilizing annealing of the component optionally takes place.

A multiplicity of technical and economic advantages are achieved with the method according to the invention.

In the first step of the method, a starting material produced by means of melting metallurgy or powder metallurgy requires merely a compacting by hot isostatic pressing of the same, after which in a second step at a temperature that is higher compared to an isothermal forging and, as was discovered, with an advantageously improved hot working capacity of the material, the blank is subjected to a rapid solid blank deformation at a rate of more than about 0.4 mm/sec and a compression degree $\phi$ of greater than about 0.3. This rapid solid-blank deformation of the blank can be carried out at increased temperature at high deformation rate, which is surprising to one skilled in the art, wherein according to the invention a high minimum deformation and a subsequent cooling at a high cooling rate are necessary for a formation of a high, initially frozen, recrystallization potential in the microstructure.

This recrystallization potential or this stored energy resulting from the rapid deformation, which is also formed from the driving force from the chemical phase imbalance, in a third step with an annealing of the material in the range of the eutectoid temperature of the alloy causes a conversion into an extremely fine globular microstructure of the phases GAMMA, $BETA_0$, $ALPHA_2$ with ordered atomic structure at room temperature with specific phase proportions, which fine structure serves as a favorable fine grain starting structure for a subsequent microstructure formation, achievable by heat treatment(s), provided with respect to desired properties of the material.

According to the invention, it may be advantageous if the starting material has a chemical composition in atomic % of:

Al from about 42 to about 44.5,
and, optionally, one or more of:
Nb from about 3.5 to about 4.5
Mo from about 0.5 to about 1.5
Mn up to about 2.2
B from about 0.05 to about 0.2
Si from about 0.001 to about 0.01
C from about 0.001 to about 1.0
from about 0.001 to about 0.1
N from about 0.0001 to about 0.02,
remainder titanium and impurities.

A chemical composition of the material of this type, which is narrower in the concentrations of the elements, can intensify a favorable behavior achieved by the process parameters regarding the microstructure formation and development.

In a third step of the method of the present invention it may be provided that the component with restricted chemical composition is subjected to a heat treatment which takes place with a duration of from about 30 min to about 600 min in the range of the eutectoid temperature of the alloy, in particular from about 1040° C. to about 1170° C., wherein from the deformation microstructure a homogeneous, fine globular microstructure is formed, composed of the phases GAMMA, $BETA_0$, $ALPHA_2$ ($\gamma$, $\gamma_0$, $\alpha_2$) and having an ordered atomic structure at room temperature:

$ALPHA_2$: globular with a grain size of from about 1 μm to about 10 μm with a volume proportion of from about 10% to about 35%, which may contain isolated, coarser $\gamma$ lamellae with a thickness of >about 100 nm;

$BETA_0$: globular surrounding the $\alpha_2$ phase, with a grain size of from about 1 μm to about 10 μm with a volume proportion of from about 15% to about 45%;

GAMMA: globular surrounding the $\alpha_2$ phase, with a grain size of from about 1 μm to about 10 μm with a volume proportion of from about 15% to about 60%;

and optionally in a subsequent step at least one further heat treatment, in particular post-annealing and/or stabilizing annealing of the component, takes place.

Although the fine-grain formation in the material, created according to the above method, with isotropic microstructural morphology causes an increased strength within narrower limits, the toughness and creep resistance of the material may, however, be deemed to be inadequate for specific fields of application. However, this fine-grain structure is at best a prerequisite for achieving a largely fine, homogeneous microstructure with further annealing treatments to adjust desired mechanical properties of the component.

In order to in particular achieve the high-temperature properties of the material regarding an improvement in the ductility or an increase in the toughness and an increase in the creep resistance, it is provided according to the invention to subject the component with a fine grain structure created in the third step, in order to adjust optimized high-temperature material properties, to at least one post-annealing that is carried out in the range close to the alpha-transus temperature ($T_\alpha$) of the alloy in the triple phase space (alpha, beta, gamma) for a duration of at least from about 30 min to about 6,000 min, after which the part is cooled within a time of less than about 10 min to a temperature of about 700° C. and subsequently further cooled, preferably in air, and in this manner a phase formation:

$ALPHA_2$: globular supersaturated, optionally containing slightly fine γ lamellae, with a grain size of from about 5 μm to about 100 μm to with a volume proportion of from about 25% to about 98%;

$BETA_0$: globular, with a grain size of from about 1 μm to about 25 μm with a volume proportion of from about 1% to about 25%;

GAMMA: globular, with a grain size of from about 1 μm to about 25 μm with a volume proportion of from about 1% to about 50%;

is formed.

In particular the supersaturated $ALPHA_2$ grains and a fine but not optimized microstructure formation result in a low material ductility and toughness at high strength values. Improved mechanical material properties can be achieved through a narrowed chemical composition, but the property profile is aimed at only specific application purposes.

Although a narrowed chemical composition of the material, as given above, can be used to achieve favorable proportions of the microstructure constituents with narrower dimensions and narrower content limits, wherein the advantages resulting therefrom are reflected in a certain specification of the mechanical property values. But essentially the prerequisites for an optimization of the high-temperature behavior of a component of a titanium-aluminum base alloy are established therewith in a highly advantageous manner.

A selection of the annealing time with a post-annealing close to the alpha-transus temperature ($T_\alpha$) can be carried out with respect to an adjustment of desired phase quantities and the grain sizes. For example, the β phase is generally reduced with increasing annealing time.

After a thermal treatment in the alpha-transus area and a forced cooling, the microstructure phases essentially have an unordered atomic structure.

If during the production process after a post-annealing the component is subjected to at least one stabilizing annealing, which is carried out in a temperature range of from about 700° C. to about 1000° C., at best above the application temperature of the component for a duration of from about 60 min to about 1000 min and a subsequent slow cooling or furnace cooling at a rate of less than about 5° C./min, preferably less than about 1° C./min, to adjust or form the microstructure constituents:

$ALPHA_2$/GAMMA: lamellar grain with a grain size of from about 5 μm to 100 μm with a volume proportion of from about 25% to about 98% with a ($\alpha_2/\gamma$) lamella fine structure preferably with an average lamella spacing of from about 10 nm to about 1 μm;

$BETA_0$: globular, with a grain size of from about 1 μm to about 25 μm with a volume proportion of from about 1% to about 25%;

GAMMA: globular, with a grain size of from about 1 μm to about 25 μm with a volume proportion of from about 1% to about 50%, microstructural formations with substantially improved mechanical high-temperature properties of the material can be achieved.

By means of a stabilizing annealing with a slow cooling in which a sufficient atomic diffusion is retained a conversion of the supersaturated $ALPHA_2$ grains into a lamellar $ALPHA_2$/GAMMA structure takes place without a substantial change of the grain size. A lamellar structure in the previously supersaturated microstructure grains improves to a high degree the creep resistance of the material at high stresses in the temperature range around 700° C.

The further objective of the invention is attained with a component having near net shape dimensions of a titanium-aluminum base alloy with a chemical composition as set forth above, produced with a microstructure of the material, composed of the phases GAMMA, $BETA_0$, $ALPHA_2$ ($\gamma$, $\beta_0$, $\alpha_2$) and having an unordered atomic structure at room temperature:

$ALPHA_2$: globular supersaturated with a grain size of from about 1 μm to about 50 μm with a volume proportion of from about 1% to about 50%, which may contain isolated, coarser γ lamellae with a thickness of >about 100 nm;

$BETA_0$: globular surrounding the $\alpha_2$ phase, with a grain size of from about 1 μm to about 25 μm with a volume proportion of from about 1% to about 50%;

GAMMA: globular surrounding the $\alpha_2$ phase, with a grain size of from about 1 μm to about 25 μm with a volume proportion of from about 1% to about 60%, preferably adjusted with a method as set forth above, wherein the material has the following mechanical properties:

Strength and elongation at break at room temperature:

$R_{p0.2}$: from about 650 to about 910 MPa $R_m$: from about 680 to about 1010 MPa $A_t$: from about 0.5% to about 3%

Strength and elongation at break at 700° C.:

$R_{p0.2}$: from about 520 to about 690 MPa $R_m$: from about 620 to about 970 MPa $A_t$: from about 1% to about 3.5%.

This component created with a highly economical production has a fine, globular, homogeneous microstructure with an identical property profile of the material in all directions, which can be used advantageously for a multitude of application purposes.

In order to achieve an improvement of the mechanical material properties, in particular an increase in the creep resistance, it is advantageous if the component is formed with a microstructure of the material of:

$ALPHA_2$: globular supersaturated, optionally containing low fine γ lamellae with a grain size of from about 5 μm to about 80 μm with a volume proportion of from about 50% to about 95%;

$BETA_0$: globular, with a grain size of from about 1 μm to about 20 μm with a volume proportion of from about 1% to about 25%;

GAMMA: globular, with a grain size of from about 1 μm to about 20 μm with a volume proportion of from about 1% to about 28%, preferably adjusted according to a method as set forth above, wherein the material has the following mechanical properties:

Strength and elongation at break (according to ASTM E8M, EN 2002-1) at room temperature:

$R_{p0.2}$: from about 650 to about 940 MPa $R_m$: from about 730 to about 1050 MPa $A_t$: from about 0.2% to about 2%

Strength and elongation at break at 700° C.:

$R_{p0.2}$: from about 430 to about 620 MPa $R_m$: from about 590 to about 940 MPa $A_t$: from about 1% to about 2.5%.

A special advantage is achieved with respect to ductility, strength and creep resistance of the material in all directions to the same extent at a high level if the component is formed with a microstructure of the material, is composed of the constituents:

$ALPHA_2$/GAMMA: Lamellar grain with a grain size of from about 5 μm to about 100 μm with a volume proportion of from about 25% to about 98% with a ($\alpha_2/\gamma$) lamellar fine structure preferably with an average lamellar spacing of from about 10 nm to about 1 nm;

$BETA_0$: globular, with a grain size of from about 0.5 μm to about 25 μm with a volume proportion of from about 1% to about 25%;

GAMMA: globular, with a grain size of from about 0.5 μm to about 25 μm with a volume proportion of from about 1% to about 50%, preferably adjusted according to a method as set forth above, wherein the material has the following mechanical properties in the range of:

Strength and elongation at break (according to ASTM E8M, EN 2002-1) at room temperature:

$R_{p0.2}$: from about 710 to about 1020 MPa $R_m$: from about 800 to about 1250 MPa $A_t$: from about 0.8% to about 4%

Strength and elongation at break at 700° C.:

$R_{p0.2}$: from about 540 to about 760 MPa $R_m$: from about 630 to about 1140 MPa $A_t$: from about 1% to about 4.5%.

The invention is explained in more detail below based on images comprising only one alloy composition.

FIG. 1 shows schematically the microstructure formations of titanium-aluminum base alloys as a function of the temperature and the aluminum concentration. Furthermore, the temperature data used by one skilled in the art can be seen.

The microstructure formations shown in FIG. 2 through FIG. 5 come from a test series with an alloy containing Ti, 43.2 atomic % of Al, 4 atomic % of Nb, 1 atomic % of Mo, 0.1 atomic % of B.

This alloy has a eutectoid temperature of $T_{eu}$ 1165° C.±7° C. and an alpha-transus temperature $T_\alpha$=1243° C.±7° C., which temperatures were determined by differential thermoanalysis.

The microstructure images were taken with a 200-fold magnification with a scanning electron microscope in electron backscatter contrast.

Figure 2:
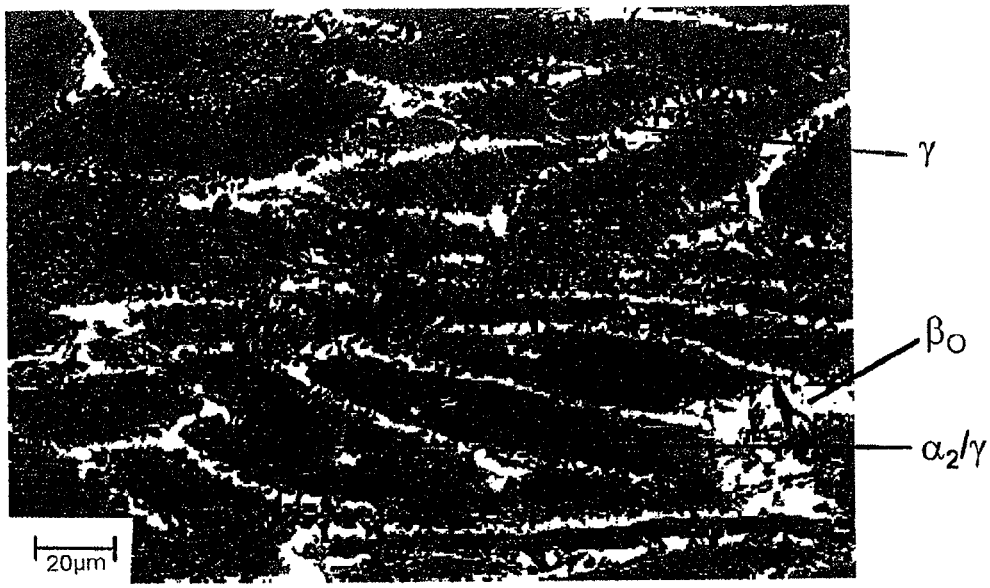
FIG. 2 is a microphotograph showing a microstructure of an Ti—Al base alloy after a solid-blank deformation and subsequent cooling.

FIG. 2 shows the microstructure of the material after a deformation in a die block with a degree of deformation of $\phi$=0.7 at a deformation rate of 1.0 mm/sec and a cooling in air. Due to the solid-blank deformation, after the cooling of the part it has a typical oriented deformation texture and shows as constituents oriented GAMMA-$BETA_0$-$ALPHA_2$ grains.

Figure 3:
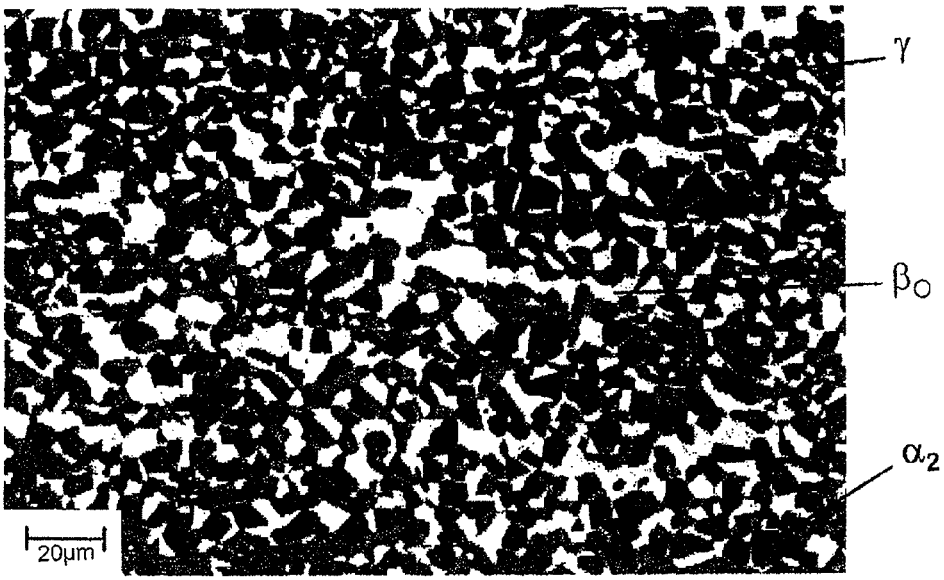
FIG. 3 is a microphotograph showing the microstructure of the alloy after an annealing in the range of the eutectoid temperature ($T_{eu}$) and cooling.

FIG. 3 shows the microstructure of the deformed part after a heat treatment in the range of the eutectoid temperature ($T_{eu}$), in the present case at 1150° C., followed by a cooling.

The structure consisted of globular $ALPHA_2$ grains with a grain size (measured as the diameter of the smallest transcribed circle) of 3.2 μm±1.9 μm with a volume proportion of about 25% of globular $BETA_0$ grains with a grain size of 3.7 μm±2.1 μm with a volume proportion of about 26% and of globular GAMMA grains with a grain size of 5.7 μm±2.4 μm with a volume proportion of 49%.

Figure 4:
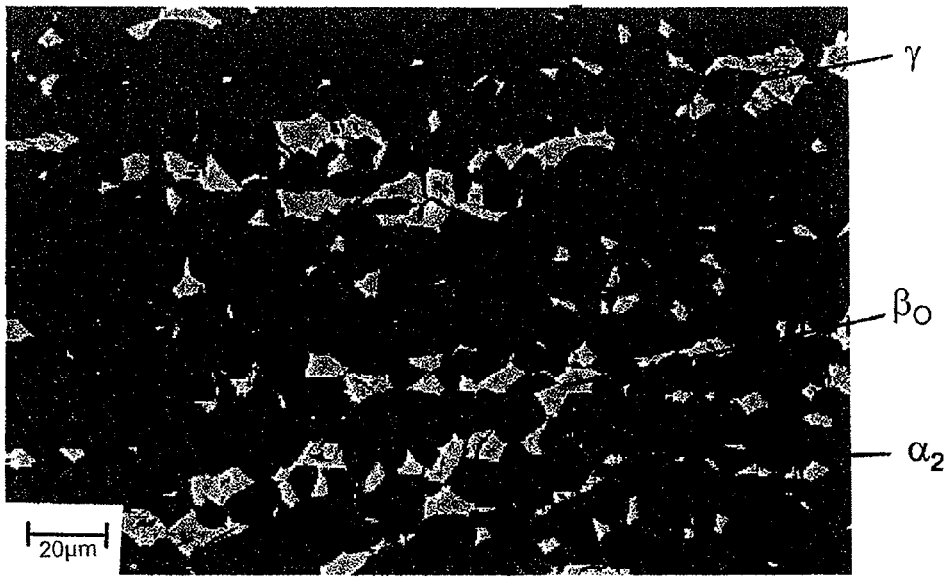
FIG. 4 is a microphotograph showing the microstructure of the alloy after an annealing at alpha-transus temperature ($T_\alpha$)

FIG. 4 shows the microstructure of the deformed part subsequently annealed at 1150° C. and cooled after a post-annealing in the range of the alpha-transus temperature ($T_\alpha$), in the given case at a temperature of 1240° C., and a cooling therefrom to 700° C. within 5 min. and further cooling in air.

The determined microstructural constituents were: $ALPHA_2$ grains in globular formation with a grain size of 11.0 μm±5.8 vim with a volume proportion of 73%, globular $BETA_0$ grains with a grain size of 4.5 μm±2.6 μm with a volume proportion of 11% and globular GAMMA grains with a grain size of 4.2 μm±2.2 μm with a volume proportion of 16%.

Figure 5:
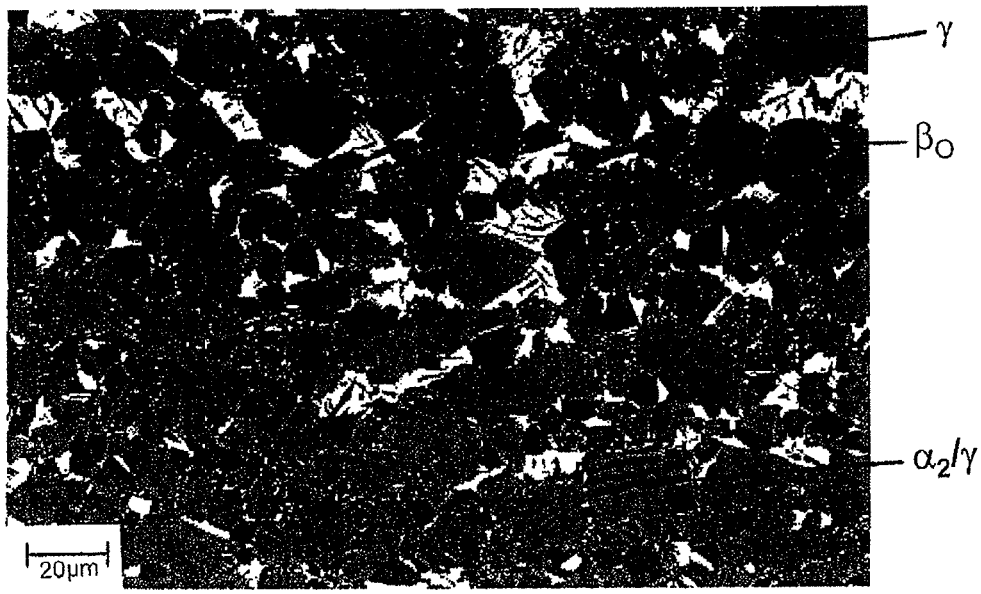
FIG. 5 is a microphotograph showing the microstructure of the alloy after a stabilizing annealing.

FIG. 5 shows the microstructure of the deformed part after a fine grain annealing in the eutectoid temperature range ($T_{eu}$), a high-temperature annealing in the ($\alpha+\beta+\gamma$) phase space or an alpha-transus annealing ($T_\alpha$) at 1240° C. and a forced cooling followed by a stabilizing annealing in the given case at 875° C. with subsequent slow cooling at a rate of 2° C./min.

At this point it should be noted that the microstrucure and the property profile of the material can be adjusted by variations in the annealing temperature and/or the annealing time.

After the above heat treatment, the microstructure was composed of globular $ALPHA_2$/GAMMA grains with lamellar $\alpha/\gamma$ structure with a grain size of 7.1 μm±3.8 μm with a volume proportion of 64% of globular $BETA_0$ grains with a grain size of 2.3 μm±2.2 μm with a volume proportion of 13% and of globular GAMMA phases with a grain size of 2.7 μm±2.1 μm with a volume proportion of 23%.

As in the case of the other samples from test series as well, the most important mechanical properties were measured on this part. At room temperature the strength values $R_{p0.2}$ were above 720 MPa, $R_m$ was above 810 MPa and the breaking elongation was above 1.6%.

At 700° C. in the creep test (ASTME139 or EN2005-5) at a test stress in the sample of 250 MPa and a load time of 100 h, a value $A_p$ of less than 0.65% was determined.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method for producing a component of a titanium-aluminum base alloy, comprising:

(a) after a through heating for at least about 60 minutes, isostatically pressing, with an increase in pressure to at least about 150 MPa at a temperature of at least about 1000° C., an alloy produced by melting metallurgy or powder metallurgy and having a chemical composition of, in atomic %:

Aluminum (Al) from about 41 to about 48 and, optionally,

Niobium (Nb) from about 4 to about 9

Molybdenum (Mo) from about 0.1 to about 3.0

Manganese (Mn) up to about 2.4

Boron (B) up to about 1.0

Silicon (Si) up to about 1.0

Carbon (C) up to about 1.0

Oxygen (O) up to about 0.5
Nitrogen (N) up to about 0.5
remainder titanium and impurities,
to form a blank, (b) subjecting the blank of (a) to a hot forming by a rapid solid-blank deformation at a rate of greater than about 0.4 mm/sec and a deformation by compression measured as local expansion $\phi$ of greater than about 0.3, $\phi$ being defined as:

$$\phi=\ln(h_f/h_o)$$

$h_f$=height of the workpiece after compression
$h_o$=height of the workpiece before compression or to a different forming method with the same minimum deformation, followed by a cooling, wherein a time until a temperature of 700° C. is reached is no more than about 10 min., to form a component that has a deformation microstructure with high recrystallization energy potential, (c) subjecting the component of (b) to a heat treatment in a range of an eutectoid temperature ($T_{eu}$) of the alloy for from about 30 min to about 1000 min, followed by cooling in air, to form from a deformation microstructure, a homogeneous, fine globular microstructure composed of phases GAMMA, $BETA_0$, $ALPHA_2$ ($\gamma$, $\beta_0$, $\alpha_2$) and having an ordered atomic structure at room temperature:

$ALPHA_2$: globular with a grain size of from about 1 μm to about 50 μm with a volume proportion of from about 1% to about 50% which may contain isolated, coarser $\gamma$ lamellae with a thickness of >about 100 nm;

$BETA_0$: globular surrounding the $\alpha_2$ phase, with a grain size of from about 1 μm to about 25 μm with a volume proportion of from about 1% to about 50%;

GAMMA: globular surrounding the $\alpha_2$ phase, with a grain size of from about 1 μm to about 25 μm with a volume proportion of from about 1% to about 50%;

(d) optionally, subjecting the component of (c) to at least one further heat treatment.

2. The method of claim 1, wherein in (b) the blank is subjected to forging at a temperature of from about 1000° C. to about 1350° C. as the different forming method with the same minimum deformation as a hot forming by a rapid solid-blank deformation.

3. The method of claim 1, wherein the range of the eutectoid temperature ($T_{eu}$) of the alloy is from about 1010° C. to about 1180° C.

4. The method of claim 1, wherein in (d) at least one of a post-annealing and a stabilizing annealing is carried out.

5. The method of claim 1, wherein the alloy has a chemical composition of, in atomic %:

Al from about 42 to about 44.5
and, optionally,
Nb from about 3.5 to about 4.5
Mo from about 0.5 to about 1.5
Mn up to about 2.2
B from about 0.05 to about 0.2
Si from about 0.001 to about 0.01
C from about 0.001 to about 1.0
O from about 0.001 to about 0.1
N from about 0.0001 to about 0.02,
remainder titanium and impurities.

6. The method of claim 5, wherein the component is subjected in (c) to a heat treatment in a range of the eutectoid temperature ($T_{eu}$) of the alloy, followed by cooling in air for from about 30 min to about 600 min, to form from the deformation microstructure a homogeneous, fine globular microstructure composed of phases GAMMA, $BETA_0$, $ALPHA_2$ ($\gamma$, $\beta_0$, $\alpha_2$) having an ordered atomic structure at room temperature:

$ALPHA_2$: globular with a grain size of from about 1 μm to about 10 μm with a volume proportion of from about 10% to about 35% which may contain isolated, coarser $\gamma$ lamellae with a thickness of >about 100 nm;

$BETA_0$: globular surrounding the $\alpha_2$ phase, with a grain size of from about 1 μm to about 10 μm with a volume proportion of from about 15% to about 45%;

GAMMA: globular surrounding the $\alpha_2$ phase, with a grain size of from about 1 μm to about 10 μm with a volume proportion of from about 15% to about 60%.

7. The method of claim 6, wherein the range of the eutectoid temperature ($T_{eu}$) of the alloy is from about 1040° C. to about 1170° C.

8. The method of claim 1, wherein in (d) the component is subjected to at least one post-annealing that is carried out close to an alpha-transus temperature ($T_\alpha$) of the alloy in a triple phase space alpha, beta, gamma for from at least about 30 min to no more than about 6000 min, followed by cooling the component for less than about 10 min to a temperature of about 700° C. and further cooling, to result in a phase formation:

$ALPHA_2$: globular supersaturated, optionally containing few fine $\gamma$ lamellae, with a grain size of from about 5 μm to about 100 μm with a volume proportion of from about 25% to about 98%;

$BETA_0$: globular, with a grain size of from about 1 μm to about 25 μm with a volume proportion of from about 1% to about 25%;

GAMMA: globular, with a grain size of from about 1 μm to about 25 μm with a volume proportion of from about 1% to about 50%.

9. The method of claim 6, wherein in (d) the component is subjected to at least one post-annealing that is carried out close to an alpha-transus temperature ($T_\alpha$) of the alloy in a triple phase space alpha, beta, gamma for from at least about 30 min to no more than about 6000 min, followed by cooling the component for less than about 10 min to a temperature of about 700° C. and further cooling, to result in a phase formation:

$ALPHA_2$: globular supersaturated, optionally containing few fine $\gamma$ lamellae, with a grain size of from about 5 μm to about 80 μm with a volume proportion of from about 50% to about 98%;

$BETA_0$: globular, with a grain size of from about 1 μm to about 20 μm with a volume proportion of from about 1% to about 25%;

GAMMA: globular, with a grain size of from about 1 μm to about 20 μm with a volume proportion of from about 1% to about 28%.

10. The method of claim 8, wherein after the at least one post-annealing the component is subjected to at least one stabilizing annealing at a temperature of from about 700° C. to about 1000° C. for from about 60 min to about 1000 min, followed by a slow cooling or furnace cooling at a rate of less than about 5° C./min to adjust or develop the microstructural constituents:

$ALPHA_2$/GAMMA: lamellar grain with a grain size of from about 5 μm to about 100 μm with a volume proportion of from about 25% to about 98% with a $\alpha_2/\gamma$ lamellar fine structure with an average lamellar spacing of from about 10 nm to about 1 μm;

$BETA_0$: globular, with a grain size of from about 1 μm to about 25 μm with a volume proportion of from about 1% to about 25%;

GAMMA: globular, with a grain size of from about 1 μm to about 25 μm with a volume proportion of from about 1% to about 50%.

11. The method of claim 10, wherein the slow cooling of furnace cooling rate is less than about 1° C./min.

12. The method of claim 9, wherein after the at least one post-annealing the component is subjected to at least one stabilizing annealing at a temperature of from about 700° C. to about 1000° C. for from about 60 min to about 1000 min, followed by a slow cooling or furnace cooling at a rate of less than about 5° C./min to adjust or develop the microstructural constituents:

$ALPHA_2$/GAMMA: lamellar grain with a grain size of from about 5 μm to about 80 μm with $\alpha_2/\gamma$ lamellar fine structure, with an average lamellar spacing of from about 10 nm to about 30 nm, and with a volume proportion of from about 45% to about 90%;

$BETA_0$: globular, with a grain size of from about 1 μm to about 20 μm with a volume proportion of from about 1% to about 25%;

GAMMA: globular, with a grain size of from about 1 μm to about 20 μm with a volume proportion of from about 1% to about 25%.

13. The method of claim 12, wherein the slow cooling of furnace cooling rate is less than about 1° C./min.

14. A component of a titanium-aluminum base alloy with a chemical composition according to claim 1, wherein a microstructure of the component is composed of phases GAMMA, $BETA_0$, $ALPHA_2$ ($\gamma$, $\beta_0$, $\alpha_2$) having an ordered atomic structure at room temperature:

$ALPHA_2$: globular with a grain size of from about 1 μm to about 50 μm with a volume proportion of from about 1% to about 50% which may contain isolated, coarser γ lamellae with a thickness of >about 100 nm;

$BETA_0$: globular surrounding the $\alpha_2$ phase, with a grain size of from about 1 μm to about 25 μm with a volume proportion of from about 1% to about 50%;

GAMMA: globular surrounding the $\alpha_2$ phase, with a grain size of from about 1 μm to about 25 μm with a volume proportion of from about 1% to about 60%, and adjusted to have the following mechanical properties:

Strength and elongation at break, according to ASTM E8M, EN 2002-1, at room temperature:

$R_{p0.2}$: from about 650 to about 910 MPa $R_m$: from about 680 to about 1010 MPa $A_t$: from about 0.5% to about 3%

Strength and elongation at break at 700° C.:

$R_{p0.2}$: from about 520 to about 690 MPa $R_m$: from about 620 to about 970 MPa $A_t$: from about 1% to about 3.5%.

15. A component of a titanium-aluminum base alloy with a chemical composition according to claim 1, wherein a microstructure of the component is composed of the following phases:

$ALPHA_2$: globular supersaturated, optionally containing few fine γ lamellae, with a grain size of from about 5 μm to about 80 μm with a volume proportion of from about 50% to about 95%;

$BETA_0$: globular, with a grain size of from about 1 μm to about 20 μm with a volume proportion of from about 1% to about 25%;

GAMMA: globular, with a grain size of from about 1 μm to about 25 μm with a volume proportion of from about 1% to about 28%, and adjusted to have the following mechanical properties:

Strength and elongation at break, according to ASTM E8M, EN 2002-1, at room temperature:

$R_{p0.2}$: from about 650 to about 940 MPa $R_m$: from about 730 to about 1050 MPa $A_t$: from about 0.2% to about 2%

Strength and elongation at break at 700° C.:

$R_{p0.2}$: from about 430 to about 620 MPa $R_m$: from about 590 to about 940 MPa $A_t$: from about 1% to about 2.5%.

16. A component of a titanium-aluminum base alloy with a chemical composition according to claim 1, wherein the component has a microstructure composed of the following phases:

$ALPHA_2$/GAMMA: Lamella grain with a grain size of from about 5 μm to about 100 μm with a volume proportion of from about 25% to about 98% with a $\alpha_2/\gamma$ lamellar fine structure preferably with an average lamellar spacing of from about 10 nm to about 1 nm;

$BETA_0$: globular, with a grain size of from about 0.5 μm to about 25 μm with a volume proportion of from about 1% to about 25%;

GAMMA: globular, with a grain size of from about 0.5 μm to about 25 μm with a volume proportion of from about 1% to about 50%, and adjusted to have the following mechanical properties:

Strength and elongation at break, according to ASTM E8M, EN 2002-1, at room temperature:

$R_{p0.2}$: from about 710 to about 1020 MPa $R_m$: from about 800 to about 1250 MPa $A_t$: from about 0.8% to about 4%

Strength and elongation at break at 700° C.:

$R_{p0.2}$: from about 540 to about 760 MPa $R_m$: from about 630 to about 1140 MPa $A_t$: from about 1% to about 4.5%.

* * * * *